United States Patent [19]

Kayman

[11] 4,310,065

[45] Jan. 12, 1982

[54] RADIAL HORN

[75] Inventor: Arnold I. Kayman, Huntington Beach, Calif.

[73] Assignee: Chromalloy Electronics Corporation, St. Louis, Mo.

[21] Appl. No.: 38,365

[22] Filed: May 11, 1979

[51] Int. Cl.[3] ..... G10K 11/00

[52] U.S. Cl. ..... 181/159; 181/185; 181/195

[58] Field of Search ..... 181/152, 159, 177, 185–192, 181/193–195; 179/115.5 H

[56] References Cited

U.S. PATENT DOCUMENTS

| | | | |
|---|---|---|---|
| 1,015,622 | 1/1912 | Hunter | 181/185 |
| 1,240,050 | 9/1917 | Johnson | 181/186 |
| 1,486,650 | 3/1924 | Foley | 181/187 |
| 1,692,994 | 11/1928 | Mattis . | |
| 1,707,545 | 4/1929 | Wente . | |
| 1,754,506 | 4/1930 | Flynn . | |
| 1,767,679 | 6/1930 | Hutchison . | |
| 1,792,655 | 2/1931 | Norton | 181/192 |
| 1,907,723 | 5/1933 | Bostwick . | |
| 1,930,915 | 10/1933 | Wente . | |
| 1,943,499 | 1/1934 | Williams . | |
| 1,962,374 | 6/1934 | Woolf et al. . | |
| 1,996,743 | 4/1935 | Blattner . | |
| 2,037,185 | 4/1936 | Thuras . | |
| 2,037,187 | 4/1936 | Wente . | |
| 2,058,208 | 10/1936 | Blattner . | |
| 2,102,668 | 12/1937 | Ballantine . | |
| 2,107,757 | 2/1938 | Kinsley . | |
| 2,183,528 | 12/1939 | Blackburn . | |
| 2,295,527 | 9/1942 | Bowley . | |
| 2,832,845 | 4/1958 | Levy . | |
| 2,873,812 | 2/1959 | Aredon . | |
| 3,032,136 | 5/1962 | Hegeman, Jr. . | |
| 3,852,529 | 12/1974 | Schaffet . | |
| 3,866,710 | 2/1975 | Cesati | 181/192 |
| 3,991,286 | 11/1976 | Henricksen . | |
| 4,050,541 | 9/1977 | Henricksen | 181/185 |
| 4,157,741 | 6/1979 | Goldwater . | |

FOREIGN PATENT DOCUMENTS

| | | | |
|---|---|---|---|
| 868454 | 1/1953 | Fed. Rep. of Germany . | |
| 248061 | 2/1926 | United Kingdom . | |
| 290387 | 5/1928 | United Kingdom | 181/185 |
| 452420 | 8/1936 | United Kingdom . | |
| 500493 | 2/1939 | United Kingdom . | |
| 566398 | 12/1944 | United Kingdom . | |

*Primary Examiner*—Lawrence R. Franklin
*Assistant Examiner*—Benjamin R. Fuller
*Attorney, Agent, or Firm*—Nilsson, Robbins, Dalgarn, Berliner, Carson & Wurst

[57] ABSTRACT

A speaker horn is adapted for coupling to a speaker drive assembly and for dispersing incident sound energy in a 360° radial pattern. The horn includes two sound-dispersing structures for making a passageway generally symmetrical about a longitudinal axis. An inserted structure restricts the movement of the incident energy in one axial direction and includes a plug which is nested in close proximity to a wall of a receiving structure at the input end of the receiving structure. The receiving structure restricts the propagation of the sound energy in the other axial direction to cooperate with the inserted structure in defining the passageway in a radial pattern between the two structures. The plug includes a concave face perpendicular to the longitudinal axis for receiving incident energy. The plug, in cooperation with the inner walls of the receiving structure, effects a change in phase of sound energy encountering the plug, and acts as an intensity amplifier for incident sound energy. The two structures cooperate to define a substantially radially uniform, substantially expanding passageway for the sound energy through the horn.

6 Claims, 3 Drawing Figures

RADIAL HORN

FIELD OF THE INVENTION

The invention pertains to speaker horns, and more particularly to such horns adapted for excitation by a speaker drive assembly and for dispersing sound energy in a radial pattern.

BACKGROUND OF THE INVENTION

The design of radial speaker horns, including such horns which are excited by speaker drive assemblies, has presented problems not amenable to ready solution. For example, the radial dispersion of sound energy emanating from a membrane of a drive assembly has been accomplished by disposing an element shaped for such dispersion in the path of the energy. However, the distance between the membrane and element and the lack of cooperating structure, conceived with considerations beyond the dispersion pattern in mind, have restricted the practically and desirabilty of such horns. Exemplary speaker horns of some interest in this regard are disclosed in Mattis U.S. Pat. No. 1,692,994, British Pat. No. 248,061, Blattner U.S. Pat. No. 1,996,743 and West German Pat. No. 868,454. Flynn U.S. Pat. No. 1,754,506 is also of some interest herein, as, to a lesser degree, are British Pat. Nos. 566,398 and 500,493.

Thus, designs for radial horns generally focus on achieving a desired radial pattern with attention to other matters, such as intensity considerations, of subsidiary concern. For example, in a number of conventional designs the radial horn includes a conical section flaring outwardly and a relatively flat (or perhaps convex) surface structure positioned opposite the flaring structure to cooperate in determining the radial pattern by deflecting sound from the conical section. This type of structure, with a membrane for a drive assembly at the small cone end, typically results in the sound energy emanating from the membrane acting upon a relatively low pressure volume which in turn acts upon a relatively high pressure volume starting at the shortest radial distance between the conical section and the surface. This sort of arrangement, normally involving a path for the sound energy which contracts at one or more points, generally sacrifices gain or amplification possibilities for other concerns.

The use of sound energy emanating from the convex side of a membrane in a drive assembly offers certain advantages which have made this type of structure conventional in a variety of applications. Since, however, particularly for high frequencies of the order of 20 kilohertz, the difference in phase of the energy emanating from near the center of the membrane may become significant with respect to that emanating from near the edges of the membrane, it has also become the practice in many applications to employ phase correctors with such membranes. These phase correctors typically include an element having a concave surface opposite the convex membrane and further having an array of holes through the surface near the periphery. In this manner, energy from the center of the membrane reflects off the non-apertured concave portion of the phase corrector surface and travels generally along the surface to reach the holes. This in effect delays or lengthens the path of such sound energy to compensate for the difference in path length between the sound from near the edges of the membrane and the sound from near the center of the membrane.

In the type of radial horn described above, such a phase corrector element would typically be placed opposite the membrane at the small or input end of the conical section.

The present invention addresses the achievement of a desired radial dispersion pattern without sacrificing amplification considerations. Further, in providing structure for addressing that goal, it in addition addresses the need for phase correction.

SUMMARY OF THE INVENTION

A speaker horn is provided for dispersing sound energy from a speaker drive assembly having a membrane for generating the sound energy. The speaker horn comprises a first sound-dispersing structure, substantially in the shape of a first surface of revolution about an axis, for restricting the propagation of the sound energy in one axial direction, and a second sound-dispersing structure, substantially in the shape of a second surface of revolution about said axis, for restricting the propagation of the sound energy in the other axial direction. The first and second sound-dispersing structures have walls for restricting the propagation of the sound energy in the axial directions. The walls define a passageway therebetween to direct the flow of the sound energy, the walls at the input end of said passageway are substantially parallel to the primary direction of motion of the diaphragm and the passageway is substantially noncontracting from the input end to the output mouth of the passageway. At least a part of the second sound-dispersing structure is nested in said first sound-dispersing structure and has a surface transverse to the axis for facing the inner portion of the membrane in sufficiently close proximity for cooperation with the membrane to force sound energy from the membrane away from the axis between and along the membrane and cooperating surface and into said passageway in phase with sound energy emanating from the peripheral portions of the membrane.

DETAILED DESCRIPTION

Figure 1:
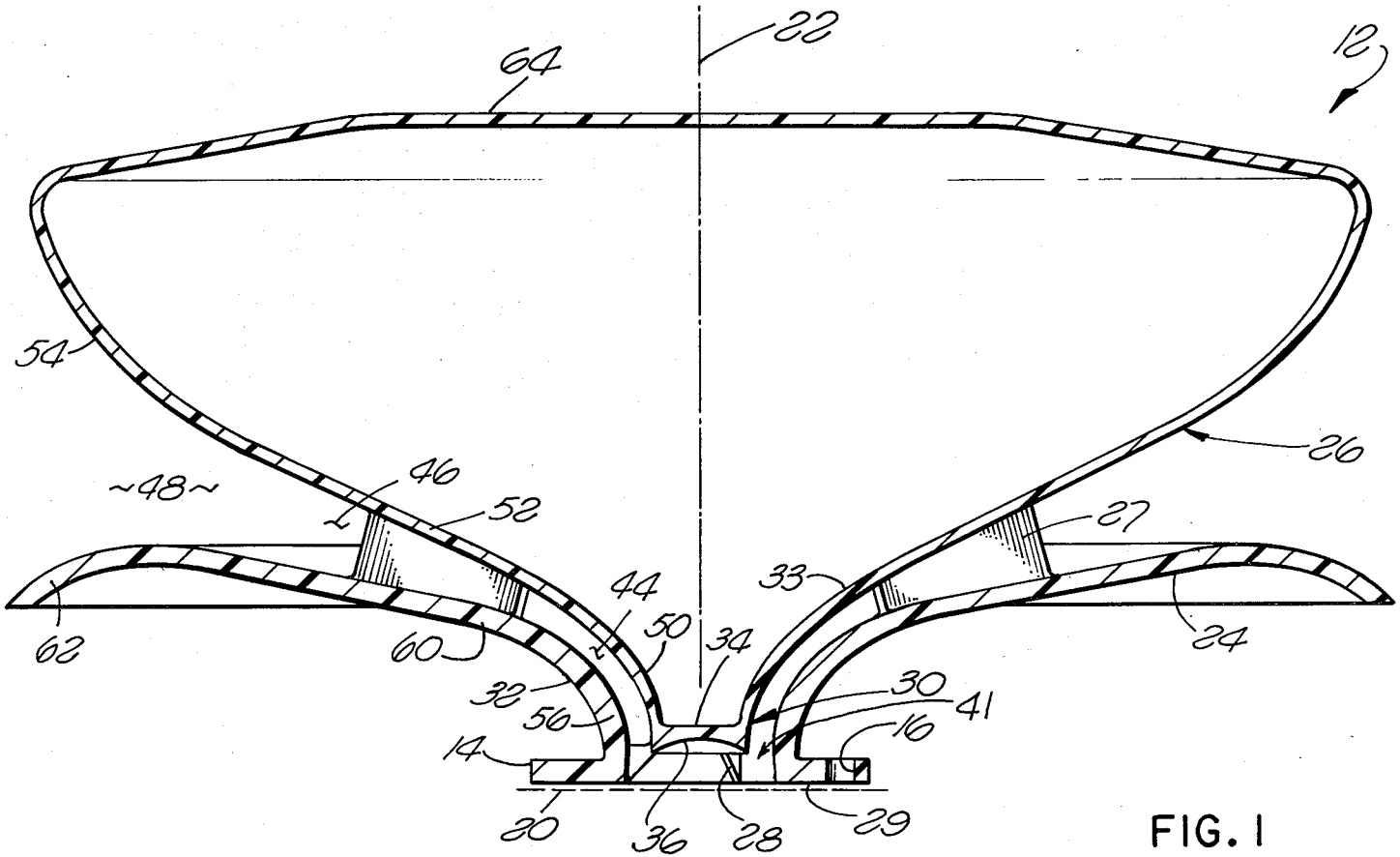
FIG. 1 is a cross-sectional elevational view showing a speaker horn in accordance with the invention.
Figure 2:
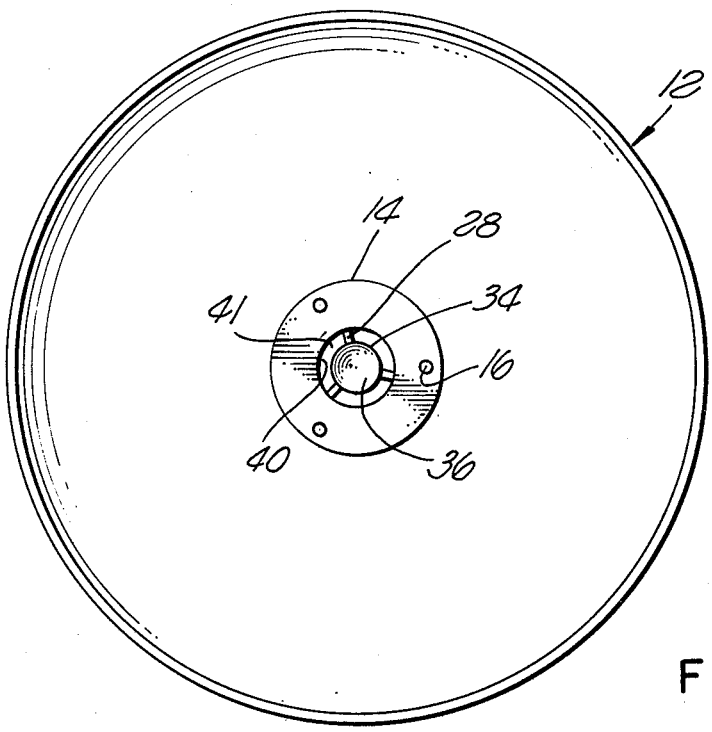
FIG. 2 is a bottom plan view of the speaker horn of FIG. 1.
Figure 3:
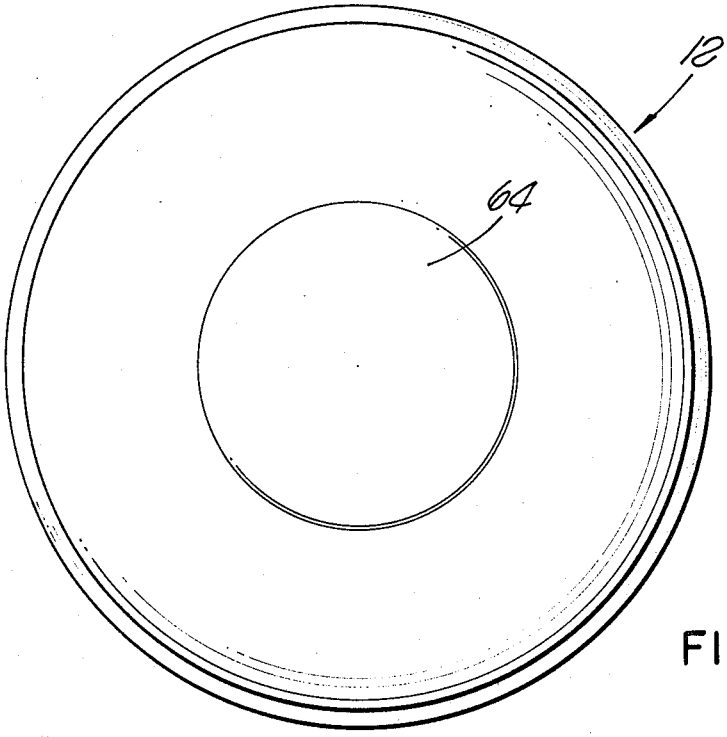
FIG. 3 is a top plan view of the speaker horn of FIG. 1.

Referring to FIG. 1, a speaker horn 12 is adapted to receive sound energy from an excitation device or driver 20 and to disperse the sound energy in a 360° radial pattern. The horn 12 includes a flange 14 by which a speaker driver assembly 20 may be attached to the horn. The flange 14 has holes 16 therethrough for such attachment (FIG. 2). In the conventional drive assembly 20, illustrated in phantom, the driver typically includes a convex (upwardly) membrane or diaphragm.

The horn is substantially symmetrical about a longitudinal axis 22, and includes a receiving structure or member 24 substantially in the shape of a surface of revolution about the longitudinal axis, and an inserted structure or member 26 which is received in or positioned adjacent the receiving structure. The inserted member 26 also takes the shape of a surface of revolution about the longitudinal axis 22. For purposes of this application, a surface of revolution is a surface that is formed by revolving a line in a plane about an axis. The inserted and receiving structures 26 and 24 are attached between their ends by four rigid interconnecting fins 27 (two shown) symmetrically disposed about the longitudinal axis 22. Three additional connecting spokes 28 (shown in FIGS. 1 and 2) connect the inserted and receiving structures 26 and 24 at the input ends 30 and 29, respectively, of the two structures.

A top closing or stabilizing member 64 is secured, by gluing or the like, to the outer end of the inserted structure 26. The stabilizing member 64 is provided to make the inserted structure rigid at the frequencies of concern where the inserted structure might otherwise be subject to vibrations.

The flange 14 and the receiving structure 24 may be formed in a unitary manner as a single element, such as by conventional molding from a wide variety of materials ranging from a glass-filled polyester compound, styrene, styrene foam, or the like, to metallic materials. The degree of acoustical deadness of the material, its dimensional stability, along with ease of formation, are primary concerns in the choice of materials. The inserted structure may be formed and molded in the same fashion of the same material. Production requirements might, for example, alternatively call for independent molding of the receiving structure and flange and their subsequent attachment by an adhesive material, according to well understood methods.

In the embodiment shown, the receiving and inserted structures 24 and 26 are separately molded from styrene as are the fins 27 and spokes 28 and the top stabilizing member 64. These parts are all later glued in place.

As is shown in FIG. 1, the sound energy from the membrane of the driver assembly 20 enters the horn between the input end 29 of the receiving structure 24 and the input end 30 of the inserted structure 26. The receiving structure wall 32 and the inserted structure wall 33 define a horn passageway for the sound energy. The propagation of the sound energy from the central portion of the driver diaphragm parallel to the longitudinal axis 22 is blocked by a plug 34 integral with the input end 30 of the inserted structure 26. The plug 34 has a concave (downwardly-facing) surface 36 or apex perpendicular to the axis 22 and which faces the upwardly convex membrane of the driver assembly 20 as shown in FIG. 1.

The 360° inserted structure 26 may be viewed as nested within the 360° receiving structure 24 to provide the passageway between the respective structure walls 33 and 32. Alternatively, the horn may be viewed as the passageway defined by the structure walls 32 and 33 in one plane and then rotated 360° about the longitudinal axis 22 to form the 360° horn. In both concepts, the space at the input end 30 of the inserted structure 26 between the walls 33 is closed by the plug 34.

In this embodiment, the membrane of the driver assembly 20 is spaced about 0.5 millimeters (0.020 inch) from the plug concave surface 36. At certain frequencies, if the sound energy from near the edges of the membrane and the center of the membrane were allowed to be propagated unimpeded, there would be a significant phase differential along the wave front which would cause undesirable interference and cancellation. However, in the horn of FIG. 1 the portion of the wavefront emanating from the central portion of the membrane will encounter the downwardly concave surface 36 of the plug 34, and generally be deflected to the passageway. In effect, this increased path of travel (or time delay) essentially changes the phase of the central portion of the wave front with respect to the peripheral portion of the wave front. The portion of the wave front from near the edges of the membrane, as in apparent by reference to FIG. 1, can of course pass substantially unimpeded into the passageway without undergoing a change in phase. From the foregoing it can be appreciated that the plug 34 acts as a phase corrector.

It will also be appreciated from the foregoing, and by reference to FIGS. 1 and 2, that the plug 34 and walls 32 and 33 of the passageway define a reduced substantially annular aperture 41, which constitutes the horn mouth, for the incident sound energy which has the effect of amplifying the intensity of the energy. Thus, the reduced aperture 41 forces the energy along a large wavefront from the diaphragm of the driver into a smaller wave front, thereby increasing the pressure at the annular aperture 41. This initial constriction or reduction initiates an efficient dispersing process characterized, after the aperture 41, by an outwardly substantially noncontracting, and in fact continually substantially expanding, passageway or horn for the sound energy which is symmetrical about the axis 22.

The horn walls 32 and 33 forming the passageway provide an initial conical section 44 extending away from the respective input ends 29 and 30 of the structures along a curved path concave away from the axis 22. The section 44 is followed by intermediate conical section 46 extending from the initial section 44. Both sections 44 and 46 expand or flare away from the input ends at the same linear rate in this embodiment. A final section 48 extends from the intermediate section 46 and, in this embodiment, expands or flares at a non-linear rate away from the input ends and axis.

The continually expanding nature of the passageway or horn is significant with respect to the intensity conservation, and gain or amplification, possibilities of the horn. Thus, the absence of contracting or constricted portions eliminates losses that come with the reflection of the sound energy. This type of expansion, in the context of a radial horn, may by analogy to directional horns be described as initially of a conical nature (the initial and intermediate sections) and then of a flared non-linear nature (the final section) such as exponential, hyperbolic, circular or the like. However, a variety of other possibilities exist including various combinations of linearly-, exponentially-, hyperbolically-, or parabolically-expanding sections. For example, each of the three sections might, in certain circumstances, conceivably be any of the above, or in fact, be made non-expanding and non-contracting. Also, other less uniformly opening sections may also be useful.

Referring in more detail to the inserted structure 26, that structure includes an initial (with respect to the path of the sound energy) wall section 50 extending away from the structure's input end 30 and concave away from the longitudinal axis 22; an intermediate substantially linear wall section 52 extending from the initial wall section 50 and also extending away from the input end and axis 22; and a final non-linearly flared wall section 54 extending from the intermediate section and away from the input end and concave toward the axis 22. The final flared wall section 54, in this particular embodiment, follows no particular mathematical curve and is substantially as shown in FIG. 1.

Similarly, the receiving structure 24 includes an initial wall section 56 extending away from the receiving structure's input end 29 and concave away from the axis 22; an intermediate substantially linear wall section 60 extending from the wall initial section 56 and also extending away from the input end and axis 22; and a final non-linearly flared wall section 62 extending from the intermediate section and away from the input end and concave toward the axis. The final flared wall section 62 has a radius of about 1.5 inches.

As may be seen in FIG. 1, the interior annular wall of the receiving structure 24 at the input end 29 is slanted outwardly at an angle of about 5° to the axis 22. This angle is designed to accommodate the particular driver used.

It will of course be appreciated by reference to FIG. 1 that the inserted structure 26 and the receiving structure 24 form a 360° horn which directs sound energy in all radial directions within an envelope formed by the walls of this horn. Their cooperation thus provides the radially symmetrical dispersion.

The radial horn 12 of the embodiment shown in FIG. 1 is particularly adapted for use with frequencies within the range from approximately 2 to 20 kilohertz. The following are typical approximate dimensions for this horn when used with a dome-shaped membrane or diaphragm approximately 1 inch in diameter at the bottom. The perpendicular distance between the inserted structure 26 and receiving structure 24 at the beginning of the initial, intermediate and final opening sections is approximately $\frac{3}{8}$ inches, $\frac{1}{4}$ inches and 13/16 inches, respectively. The distance between the inserted and receiving structures at the terminal edge of the output opening (mouth) is approximately $2\frac{3}{4}$ inches. The diameter of the circle defined by the outer edges of the concave surface 36 of the plug is approximately $\frac{5}{8}$ inches. In the best embodiment, a line bisecting the angle between the two intermediate linear wall sections 52 and 60 is 85° from the longitudinal axis 22. This angle was arrived at through experimentation in order to provide the best dispersion parallel to the longitudinal axis within the 2 to 20 kilohertz frequency range.

The horn walls are thick enough to prevent resonance of the horn at the anticipated frequencies. Additionally, the hollowed-out form of the inserted structure is particularly effective in avoiding resonance and vibration, and might be filled with a deadening material such as urethane foam. In order to make the horn aperiodic, the wall thicknesses will generally be greater than would be required for mere rigidity. These thicknesses will depend upon other horn dimensions, the construction material employed, and the anticipated power delivered to the driver assembly.

It will of course be appreciated that horns along the lines of the described embodiment and in accordance with the invention may be made for a variety of frequency ranges, and further, that various modifications may be made in the described embodiment without departing from the scope of the invention. Specifically, some dimensions may be changed without changing other dimensions, the entire structure may be scaled up or down, and the shape of the passageway may be changed.

What is claimed is:

1. A speaker horn for dispersing sound energy provided by a speaker drive assembly having a membrane for generating the sound energy, said speaker horn comprising:

a first sound-dispersing structure, substantially in the shape of a first surface of revolution about an axis, for restricting the propagation of the sound energy in one axial direction;

a second sound-dispersing structure, substantially in the shape of a second surface of revolution about said axis, for restricting the propagation of the sound energy in the other axial direction, said first and second sound-dispersing structures having walls for restricting the propagation of the sound energy in the axial directions, said walls defining a passageway therebetween to direct the flow of the sound energy, said walls at the input end of said passageway being substantially parallel to the primary direction of motion said membrane and said passageway being substantially noncontracting from the input end to the output mouth of the passageway;

at least a part of said second sound-dispersing structure being nested in said first sound-dispersing structure and having a surface transverse to said axis for facing the inner portion of the membrane in sufficiently close proximity for cooperation with the membrane to force sound energy from the membrane away from said axis between and along the membrane and the cooperating surface and into said passageway in phase with sound energy emanating from peripheral portions of the membrane; and, said cooperating surface and said first sound-dispersing structure defining an entrance to said passageway for facing the membrane, said entrance being shaped to recieve sound energy emanating substantially solely from membrane portions facing said cooperating surface and said entrance.

2. A speaker horn for dispersing sound energy as defined in claim 1 wherein said passageway directs the sound out of the horn at an angle to said axis which is greater than 45 degrees.

3. A speaker horn for dispersing sound energy as defined in claim 1 wherein said cooperating surface is a concave surface symmetrical about said axis.

4. A speaker horn for dispersing sound energy as defined in claim 1 wherein said cooperating surface is a concave surface perpendicular to said axis.

5. A speaker horn for dispersing sound energy as defined in claim 1 wherein said cooperating surface and the walls of said first sound-dispersing structure define a substantially annular entrance into said passageway.

6. A speaker horn for dispersing sound energy as defined in claim 1 wherein said passageway is substantially expanding from substantially said entrance to the output mouth of the horn and is substantially symmetrical through 360° about the axis.

* * * * *

UNITED STATES PATENT AND TRADEMARK OFFICE

CERTIFICATE OF CORRECTION

PATENT NO. : 4,310,065

DATED : Jan. 12, 1982

INVENTOR(S) : Arnold I. Klayman, Huntington Beach, Calif.

It is certified that error appears in the above-identified patent and that said Letters Patent are hereby corrected as shown below:

On the title page

Item [75] Change "Kayman" to --Klayman--

Also the line below Item [19] Change "Kayman" to --Klayman--

Signed and Sealed this

*Twelfth* Day of *April 1983*

[SEAL]

*Attest:*

GERALD J. MOSSINGHOFF

*Attesting Officer*

*Commissioner of Patents and Trademarks*